US006102816A

United States Patent [19]

Sullivan et al.

[11] Patent Number: 6,102,816

[45] **Date of Patent: *Aug. 15, 2000**

[54] GOLF BALL

[75] Inventors: Michael J. Sullivan, Chicopee; Dennis Nesbitt, Westfield; Mark Binette, Ludlow, all of Mass.

[73] Assignee: Spalding Sports Worlwide, Inc., Chicopee, Mass.

[ * ] Notice: This patent is subject to a terminal disclaimer.

[21] Appl. No.: 09/188,205

[22] Filed: Nov. 9, 1998

Related U.S. Application Data

[63] Continuation-in-part of application No. 08/887,053, Jul. 2, 1997, Pat. No. 5,833,554, which is a continuation-in-part of application No. 08/530,851, Sep. 20, 1995, Pat. No. 5,766,098, which is a division of application No. 08/171,956, Dec. 22, 1993, Pat. No. 5,503,397, which is a continuation of application No. 07/800,198, Nov. 27, 1991, Pat. No. 5,273,287.

[51] Int. Cl.[7] ..... A63B 37/06

[52] U.S. Cl. ..... 473/374; 473/377; 473/384

[58] Field of Search ..... 473/374, 377, 473/384

[56] References Cited

U.S. PATENT DOCUMENTS 5,833,554 11/1998 Sullivan et al. ..... 473/374

*Primary Examiner*—Sebastiano Passaniti
*Assistant Examiner*—Raeann Gordon
*Attorney, Agent, or Firm*—Laubscher & Laubscher

[57] ABSTRACT

A golf ball having an outside diameter of at least 1.70 inches which includes a core, an inner cover, or mantle, and an outside cover. The mantle and the outer cover have a different Shore D hardness. Dimples cover at least seventy percent of the outer surface area of the ball. In one embodiment, the mantle has a Shore D hardness between 50 and 60 and the cover has a Shore D hardness of 65 or less with the mantle hardness being greater than the cover hardness. In another embodiment, the mantle has a Shore D hardness of 65 or less and the cover has a Shore D hardness between 50 and 60, with the cover hardness being greater than the mantle hardness.

2 Claims, 4 Drawing Sheets

GOLF BALL

This application is a continuation-in-part of U.S. patent application Ser. No. 08/887,053 filed Jul. 2, 1997, now U.S. Pat. No. 5,833,554 which is a continuation-in-part of U.S. patent application Ser. No. 08/530,851 filed Sep. 20, 1995, now U.S. Pat. No. 5,766,098 which is a division of U.S. patent application Ser. No. 08/171,956 filed Dec. 22, 1993, now U.S. Pat. No. 5,503,397, which is a continuation of U.S. patent application Ser. No. 07/800,198 filed Nov. 27, 1991, now U.S. Pat. No. 5,273,287.

BACKGROUND OF THE INVENTION

This invention relates to golf balls. In particular, it relates to a three-piece golf ball having playability characteristics which are improved relative to state-of-the-art balls.

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a golf ball will travel when hit in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

The foregoing generalizations hold when the effect of size, weight, or initial velocity is measured in isolation. Flight characteristics (influenced by dimple pattern and ball rotation properties), club head speed, radius of gyration, and diverse other factors also influence the distance a ball will travel:

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials and by alterations in dimple configuration.

BRIEF DESCRIPTION OF THE PRIOR ART

Golf balls not conforming to U.S.G.A. specifications in various respects have been made in the United States. Prior to the effective date of the U.S.G.A. rules, balls of various weight, diameters, and resiliencies were common. So-called "rabbit balls," which claim to exceed the U.S.G.A. initial velocity, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball should include a cover having a thickness less than the cover thickness of conventional ball. The patent has no disclosure as to dimple size or the percentage of surface coverage by the dimples.

Golf balls made by Spalding in 1915 were of a diameter ranging from 1.630 inches to 1.710 inches. While these balls had small shallow dimples, they covered less than 50% of the surface of the ball. Additionally, as the diameter of the ball increased, the weight of the ball also increased.

Golf balls known as the LYNX JUMBO were also produced and sold in October of 1979. This ball had a diameter of substantially 1.80 inches. The dimples on the LYNX JUMBO balls had 336 Atti-type dimples with each dimple having a diameter of 0.147 inch and a depth of 0.0148 inch. With this dimple arrangement, 56.02% of the surface area of the ball was covered by the dimples. This ball met with little or no commercial success.

Top-grade golf balls sold in the United States may be classified as one of two types: two-piece or three-piece. The two-piece ball, exemplified by the balls sold by Spalding Sports Worldwide under the trademark TOP-FLITE, consists of a solid polymeric core and a separately formed cover. The so-called three-piece ball, exemplified by the balls sold under the trademark TITLEIST by the Acushnet Company, consists of a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal slats. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. Top-grade golf balls, however, must meat several other important design criteria. To successfully compete in today's golf market, a golf ball should be resistant to cutting and must be finished well; it should hold a line in putting and should have good click and feel. With a well-designed ball, experienced players can better execute shots involving draw, fade, or abrupt stops, as the situation dictates.

SUMMARY OF THE INVENTION

The golf ball of the present invention provides an improvement over previously proposed oversized golf balls. The present ball has an outside diameter of at least 1.70 inches and comprised a core, an inner cover, or mantle, and an outer cover. The mantle and the outer cover have a different Shore D hardness. Dimples cover at least seventy percent of the outer surface area of the ball.

BRIEF DESCRIPTION OF THE FIGURES

Other objects and advantages of the invention will become apparent from a study of the following specification, when viewed in the light of the accompanying drawing, in which.

DETAILED DESCRIPTION OF THE PREFERRED EMBODIMENT

Figure 1B:
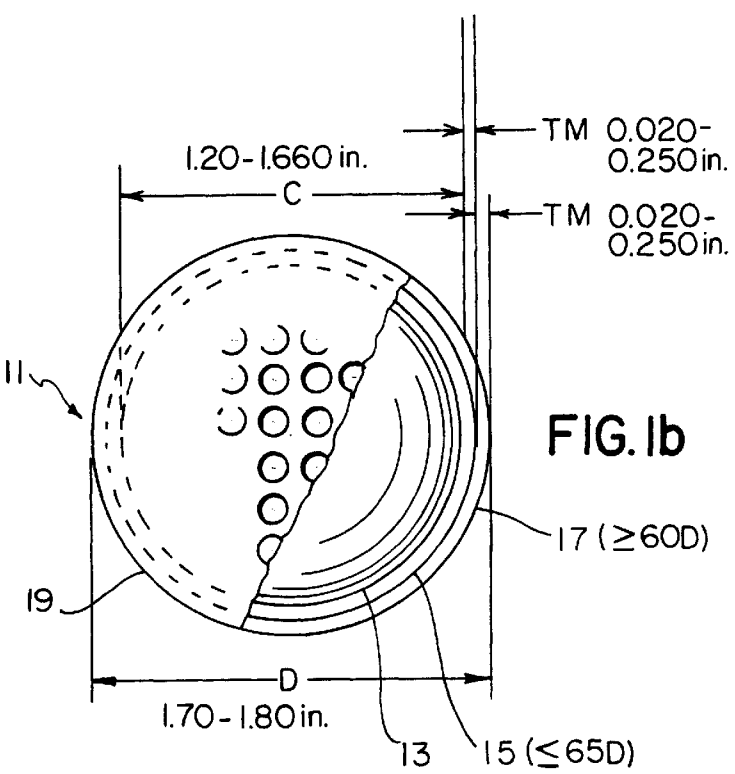
FIGS. 1*a*–1*d* are partially broken-away views of first, second, third, and fourth embodiments, respectively, of the improved golf ball of the present invention.

The following description relates to several particular embodiments of the golf ball of the present invention, but the concept of the present invention is not to be limited to such embodiments. It should be noted that all of the specific dimensions set forth have a manufacturing tolerance of ±0.05%. Additionally, all the balls have a weight no greater than 1.62 ounces.

In each of the embodiments of FIGS. 1*a*–1*d,* the golf ball 11 of the invention includes a core 13, a mantle layer 15 which covers the core, and an outer cover layer 17 which covers the mantle layer. Dimples 19 are provided in the surface of the cover.

The ball 11 has an outer diameter D, the core layer 13 has a diameter C, the mantle layer 15 has a thickness TM and the cover layer has a thickness TC.

The invention is characterized by forming the mantle and cover layers from materials having different Shore D hardness. As used herein, Shore D hardness of the mantle and cover layers is measured generally in accordance with ASTM D-2240, except that the measurements are made on the curved surface of a molded mantle or cover, rather than on a plaque. Furthermore, the Shore D hardness of the mantle layer is measured while the mantle layer remains over the core and the Shore D hardness of the cover layer remains over the mantle layers. When a hardness measurement is made on a dimpled cover layer, the Shore D hardness is measured at a land area of the dimpled cover layer.

The resilience of coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration (i.e., dimple pattern and area of dimple coverage) as well as environment conditions (e.g., temperature, moisture, atmospheric pressure, wind, etc.) generally determine the distance a ball will travel when hit. Along this line, the distance a golf ball will travel under controlled environment conditions is a function of the speed and mass of the club and size, density and resilience (COR) of the ball, and other factors. The initial velocity of the club, the mass of the club, and the angle of the ball's departure are essentially provided by the golfer upon striking. Since club head club head mass, the angle of trajectory, and environmental condition are determines controllable by golf ball producers and the ball size and weight are set by the U.S.G.A., these are not factors of concern among golf ball manufacturers. The factors or determinants of interest with respect to improved distance are generally the coefficient of restitution (COR) and the surface configuration (dimple pattern, ratio of land area to dimple area, etc.) of the ball.

The COR is solid core balls is a function of the composition of the molded core and of the cover. The molded core and/or cover may be comprised of one or more layers such as in multi-layered balls. In balls containing a wound core (i.e., balls comprising a liquid or solid center, elastic windings, and a cover), the coefficient of restitution is a function of not only the composition of the center and cover, but also the composition and tension of the elastomeric windings. As in the solid core balls, the center and cover of a wound core ball may also consist of one or more layers.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of Oehler Mark 55 ballistic screens available from Oehler Research, Inc., P.O. Box 9135, Austin, Tex. 78766, which provide a timing pulse when an object passes through them: The screens were separated by 36" and are located 25.25" and 61.25" from the rebound wall. The ball speed was measured by timing the pulses from screen 1 to screen 2 on the way into the rebound wall (as the average speed of the ball over 36"), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel 2.0 inches thick.

As indicated above, the incoming speed should be 125±5 fps but corrected to 125 fps. The correction between COR and forward or incoming speed has been studied and a correction has been made over the ±5 fps range so that the COR is reported as if the ball had an incoming speed of exactly 125.0 fps.

The coefficient of restitution must be carefully controlled in all commercial golf balls if the ball is to be within the specification regulated by the United States Golf Association (U.S.G.A.). As mentioned to some degree above, the U.S.G.A. standards indicate that a "regulation" ball cannot have an initial velocity exceeding 255 feet per second in an atmosphere of 75 F. when tested in a U.S.G.A. machine. Since the coefficient of restitution of a ball is related to the ball's initial velocity, it is highly desirable to produce a ball having sufficiently high coefficient of restitution to closely approach the U.S.G.A. limit on initial velocity, while having an ample degree of softness (i.e., hardness) to produce enhanced playability (i.e., spin, etc).

PGA compression is another important property involved in the performance of a golf ball. The compression of the ball can affect the playability of the ball on striking and the sound or "click" produced. Similarly, compression can effect the "feel" of the ball (i.e., hard or soft responsive feel), particularly in chipping and putting.

Moreover, while compression itself has little bearing on the distance performance of a ball, compression can affect the playability of the ball on striking. The degree of compression of a ball against the club face and the softness of the cover strongly influences the resultant spin rate. Typically, a softer cover will produce a higher spin rate than a harder cover. Additionally, a harder core will produce a higher spin rate than a softer core. This is because at impact a hard core serves to compress the cover of the ball against the face of the club to a much greater degree than a soft core, thereby resulting in more "grab" of the ball on the clubface and subsequent higher spin rates. In effect, the cover is squeezed between the relatively incompressible core and clubhead. When a softer core is used, the cover is under much less compressive stress than when a harder core is used and therefore does not contact the clubface as intimately. This results in lower spin rates.

The term "compression" utilized in the golf ball trade generally defines the overall deflection that a golf ball undergoes when subjected to a compressive load. For example, PGA compression indicates the amount of change in a golfball's shape upon striking. The development of solid core technology in two piece balls has allowed for much more precise control of compression in comparison to thread wound three-piece balls. This is because in the manufacture of solid core balls, the amount of deflection or deformation is precisely controlled by the chemical formula used in making the cores. This differs from wound three-piece balls wherein compression is controlled in part by the winding process of the elastic thread. Thus, two-piece and multilayer solid core balls exhibit much more consistent compression readings than balls having wound cores such as the thread wound three-piece balls.

In the past, PGA compression related to a scale of from 0 to 200 given to a golf ball. The lower the PGA compression value, the softer the feel of the ball upon striking. In practice, tournament quality balls have compression ratings around 70–110, preferably around 80 to 100.

In determining PGA compression using the 0–200 scale, a standard force is applied to the external surface of the ball. A ball which exhibits no deflection (0.0 inches in deflection) is rated 200 and a ball which deflects 2/10th of an inch (0.2 inches) is rated 0, Every change of 0.001 of an inch represents a 1 point drop in compression. Consequently, a ball which deflects 0.1 inches (100×0.001 inches) has a PGA compression value of 100 (i.e., 200−100) and a ball which deflects 0.110 inches (110×0.001 inches) has a PGA compression of 90 (i.e., 200−110).

In order to assist in the determination of compression, several devices have been employed by the industry. For example, PGA compression is determined by an apparatus fashioned in the form of a small press with an upper and lower anvil. The upper anvil is at rest against a 200-pound die spring, and the lower anvil is movable through 0.300 inches by means of a crank mechanism. In its open position the gap between the anvils is 1.780 inches, allowing a clearance of 0.100 inches for insertion of the ball. As the lower anvil is raised by the crank, it compresses the ball against the upper anvil, such compression occurring during the last 0.200 inches of stroke of the lower anvil, the ball then loading the upper anvil which in turn loads the spring. The equilibrium point of the upper anvil is measured by a dial micrometer if the anvil is deflected by the ball more than 0.100 inches (less deflection is simply regarded as zero compression) and the reading on the micrometer dial is referred to as the compression of the ball. In practice, tournament quality balls have compression ratings around 80 to 100 which means that the upper anvil was deflected a total of 0.120 to 0.100 inches.

An example to determine PGA compression can be shown by utilizing a golf ball compression tester produced by Atti Engineering Corporation of Newark, N.J. The value obtained by this tester relates to an arbitrary value expressed by a number which may range from 0 to 100, although a value of 200 can be measured as indicated by two revolutions of the dial indicator on the apparatus. The value obtained defines the deflection that a golf ball undergoes when subjected to compressive loading. The Atti test apparatus consists of a lower movable platform and an upper movable spring-loaded anvil. The dial indicator is mounted such that it measures the upward movement of the spring-loaded anvil. The golf ball to be tested is placed in the lower platform, which is then raised a fixed distance. The upper portion of the golf ball comes in contact with and exerts a pressure on the springloaded anvil. Depending upon the distance of the golf ball to be compressed, the upper anvil is forced upward against the spring.

Alternative devices have also been employed to determine compression. For example, Applicant also utilized a modified Riehle Compression Machine originally produced by Riehle Bros. Testing Machine Company, Philadelphia, Pa., to evaluate compression of the various components (i.e., cores, mantle cover balls, finished balls, etc.) of the golf balls. The Riehle compression device determines deformation in thousandths of an inch under a fixed initialized load of 200 pounds. Using such a device, a Riehle compression of 61 corresponds to a deflection under load of 0.061 inches.

Additionally, an approximate relationship between Riehle compression and PGA compression exists for balls of the same size. It has been determined by Applicant that Riehle compression corresponds to PGA compression by the general formula PGA compression=160- Riehle compression. Consequently, 80 Riehle compression corresponds to 80 PGA compression, 70 Riehle compression corresponds to 90 PGA compression and 60 Riehle compression corresponds to 100 PGA compression. For reporting purposes, Applicant's compression values are usually measured as Riehle compression and converted to PGA compression.

Furthermore, additional compression devices may also be utilized to monitor golf ball compression so long as the correlation to PGA compression is known. These devices have been designed, such as a Whitney Tester, to correlate or correspond to PGA compression through a set relationship or formula.

Figure 1A:
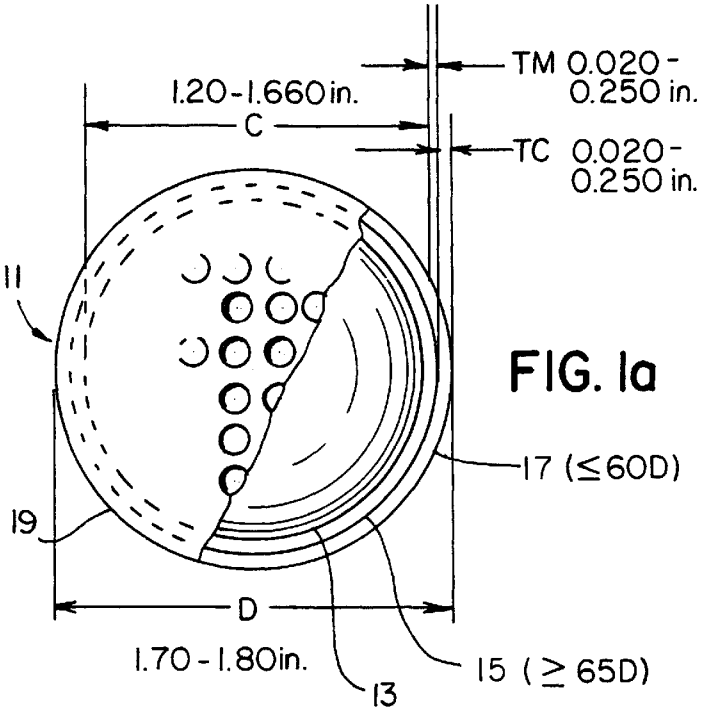

The first embodiment of the present invention shown in FIG. 1*a* provides a mantle layer 15 which entirely covers the core 13. The mantle 15 is comprised of a hard ionomer or other hard polymer having a Shore D hardness of about 65 or more and outer cover layer 17 is comprised of a soft ionomer or other elastomer having a Shore D hardness of about 60 or less.

It has been found that multi-layer golf balls having inner and outer cover layers exhibit high COR values and have greater travel distance in comparison with balls made from a single cover layer.

In addition, the softer outer layers adds to the desirable "feel" and high spin rate while maintaining respectable resiliency. The soft outer layer allows the cover to deform more during impact and increases the area of contact between the club face and the cover, thereby imparting more spin on the ball. As a result, the soft cover provides the ball with a balata-like feel and playability characteristics with improved distance and durability.

For a ball having a diameter of at least 1.70", the diameter of the core layer C is preferably between 1.20 and 1.660 inches.

The thickness of the mantle layer TM is preferably between 0.020 inches and 0.250 inches and the thickness of the outer cover layer TC is preferably between 0.020 inches and 0.250 inches.

In the second embodiment shown in FIG. 1*b,* the mantle layer 15 is comprised of an ionomer layer which is softer than the outer cover layer 17 and has a Shore D hardness of 65 or less, most preferably 10–60 and most preferably between 30–60. Outer cover layer is comprised of an ionomer having a Shore D hardness of about 60 or more, and preferably between 65 and 68, most preferably between 65–75.

The ball of this embodiment has a relatively low PGA compression of less than 90 and preferably 80 or less. This ball has good travel distance and a low spin rate by virtue of the combination of a hard cover and a soft core and mantle.

In this embodiment, the diameter of the core C is preferably between 1.20 inches and 1.60 inches, the thickness of the mantle layer TM is preferably between 0.020 inches and 0.250 inches and the thickness of the outer cover layer TC is preferably between 0.020 inches and 0.250 inches.

Figure 1C:
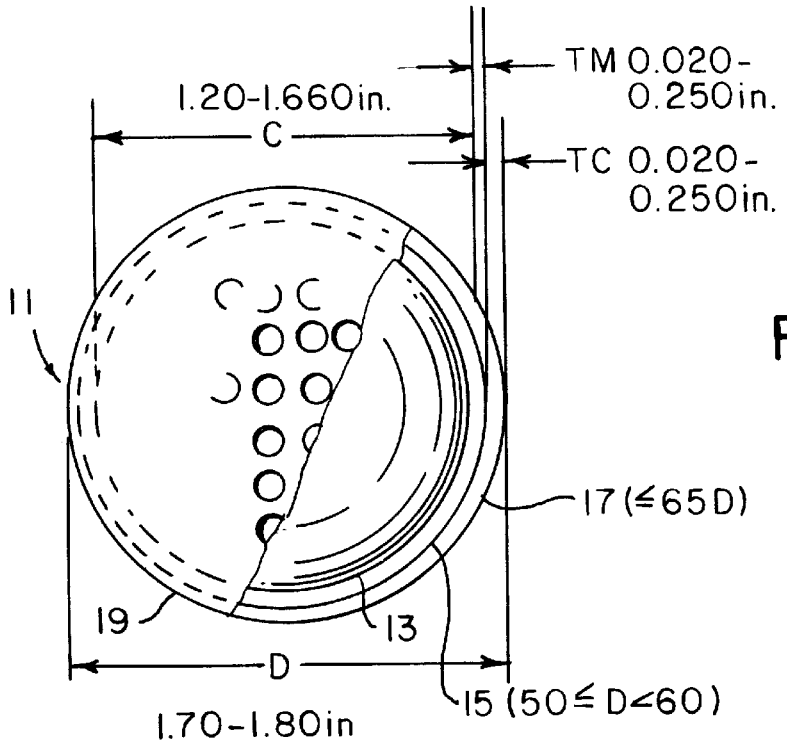
Figure 1D:
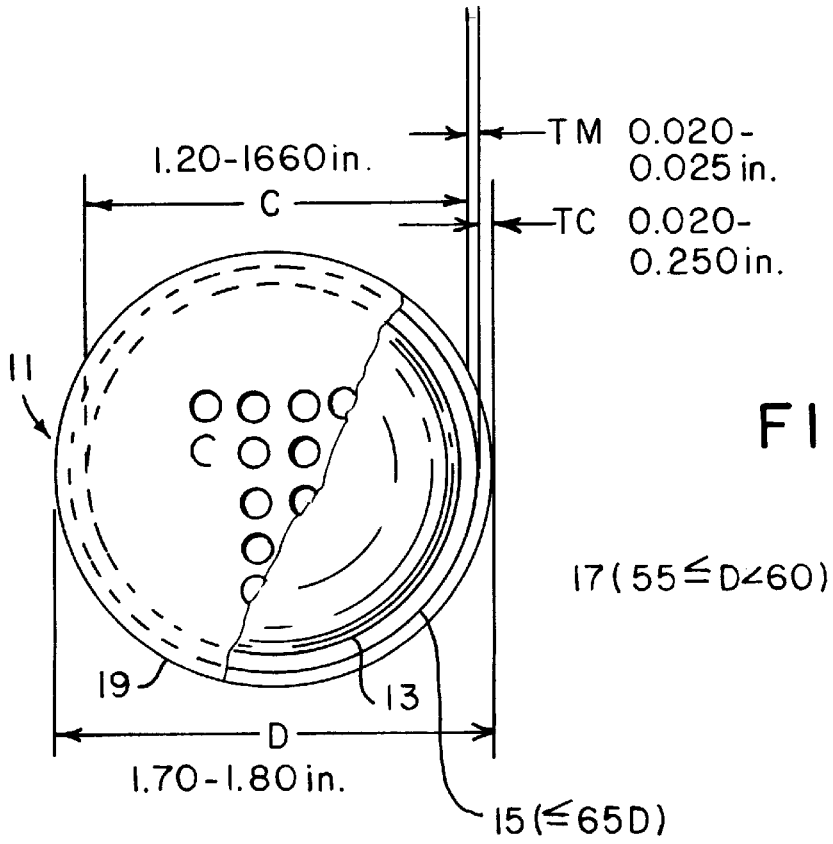

The balls of the third and fourth embodiments shown in FIGS. 1*c* and 1*d,* respectively, have the same outer diameter D, core diameter C, mantle thickness TM, and cover thickness TC, as the balls of the first and second embodiments. The differences are in the Shore D hardness of the mantle and cover layers.

In the third embodiment of FIG. 1*c,* the mantle layer 15 has a Shore D hardness of about 50 or more and the cover layer 17 has a Shore D hardness of about 65 or less, so long as the mantle hardness is greater than the cover hardness.

In the fourth embodiment of FIG. 1*d,* the mantle layer 15 has a Shore D hardness of about 65 or less and the cover layer has a Shore D hardness of about 55 ore more, so long as the cover hardness is greater than the mantle hardness.

Figure 2:
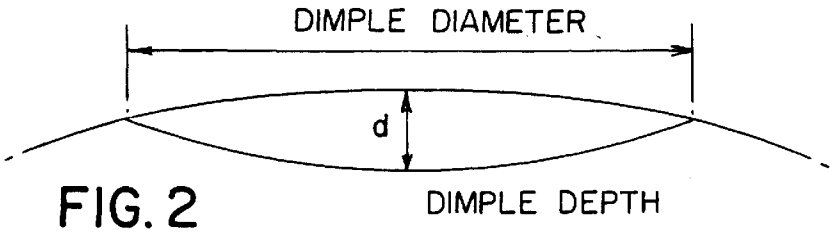
FIG. 2 illustrates dimple diameter and depth measurements.
Figure 3:
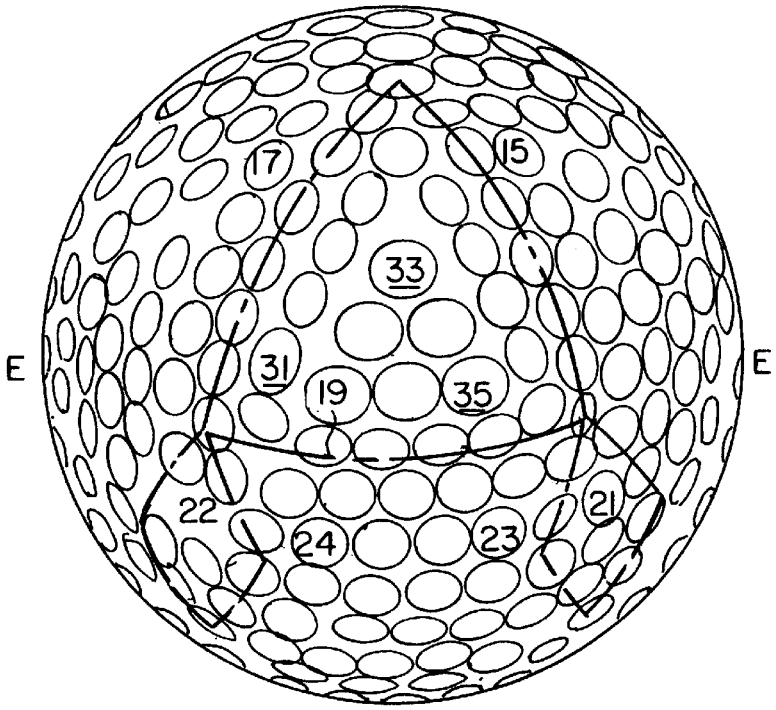
FIGS. 3, 4, and 5 disclose different dimple patterns, respectively, which may be used with the present invention.

Referring to FIG. 3, there is shown a ball having the enlarged dimensions of the present invention and having a dimple pattern including 422 dimples, which includes dimples of the three different diameters and depths measured in accordance with FIG. 2. As indicated in FIG. 3, the largest dimple 33 diameter is 0.169 inch, with a dimple depth of 0.0123 inch, the intermediate dimple 35 diameter is 0.0157 inch with a dimple depth of 0.0124, and the smallest dimple 31 diameter is 0.145 inch with a dimple depth of 0.0101 inch. With the pattern shown, the resultant weighted average dimple diameter is 0.1478 inch and the weighted average dimple depth is 0.0104 inch. With this configuration and dimple size, 78.4% of the surface area of the ball is covered by dimples, without any dimple overlap. The ball of FIG. 3 includes repeating patterns bounded by lines 15, 17, and 19 about each hemisphere, with the hemispheres being identical. One of such patterns is shown in FIG. 5, which indicates the arrangement of dimples and the relative sizes of the dimples in that particular pattern.

Figure 4:
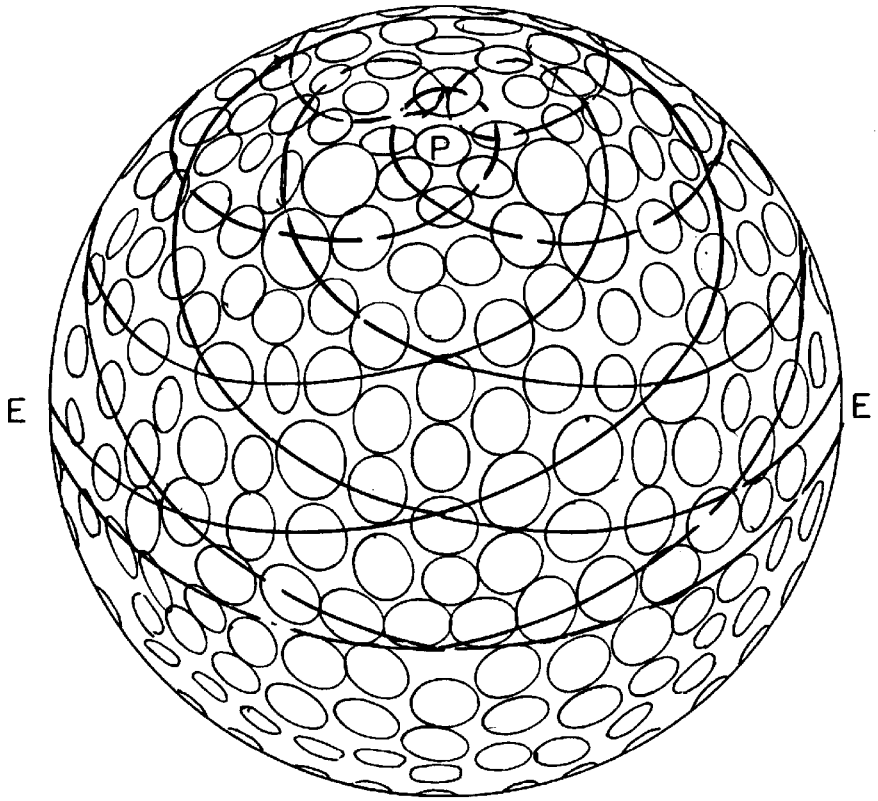

A further modification is shown in FIG. 4. This golf ball has 410 dimples comprising 138 dimples having a diameter of 0.169 inch and a depth of 0.0116 inch, 160 dimples having a diameter of 0.143 inch and a depth of 0.0101 inch, and 112 dimples having a diameter of 0.112 inch and a depth of 0.0077 inch. The configuration of the dimples comprises a dimple-free equatorial line E—E dividing the ball into two hemispheres having substantially identical dimple patterns. The dimple pattern of each hemisphere comprises a first plurality of dimples extending in four spaced clockwise arcs between the pole and the equator of each hemisphere, a second plurality of dimples extending in four spaced counterclockwise arcs between the pole and equator of each hemisphere, and a third plurality of dimples filling the surface area between the first and second plurality of dimples. In this ball, none of the dimples overlap. This pattern provides a weighted average dimple diameter of 0.1433 inch, weighted average dimple depth of 0.010 inch, and a 73.1% coverage of the surface of the ball.

Figure 5:
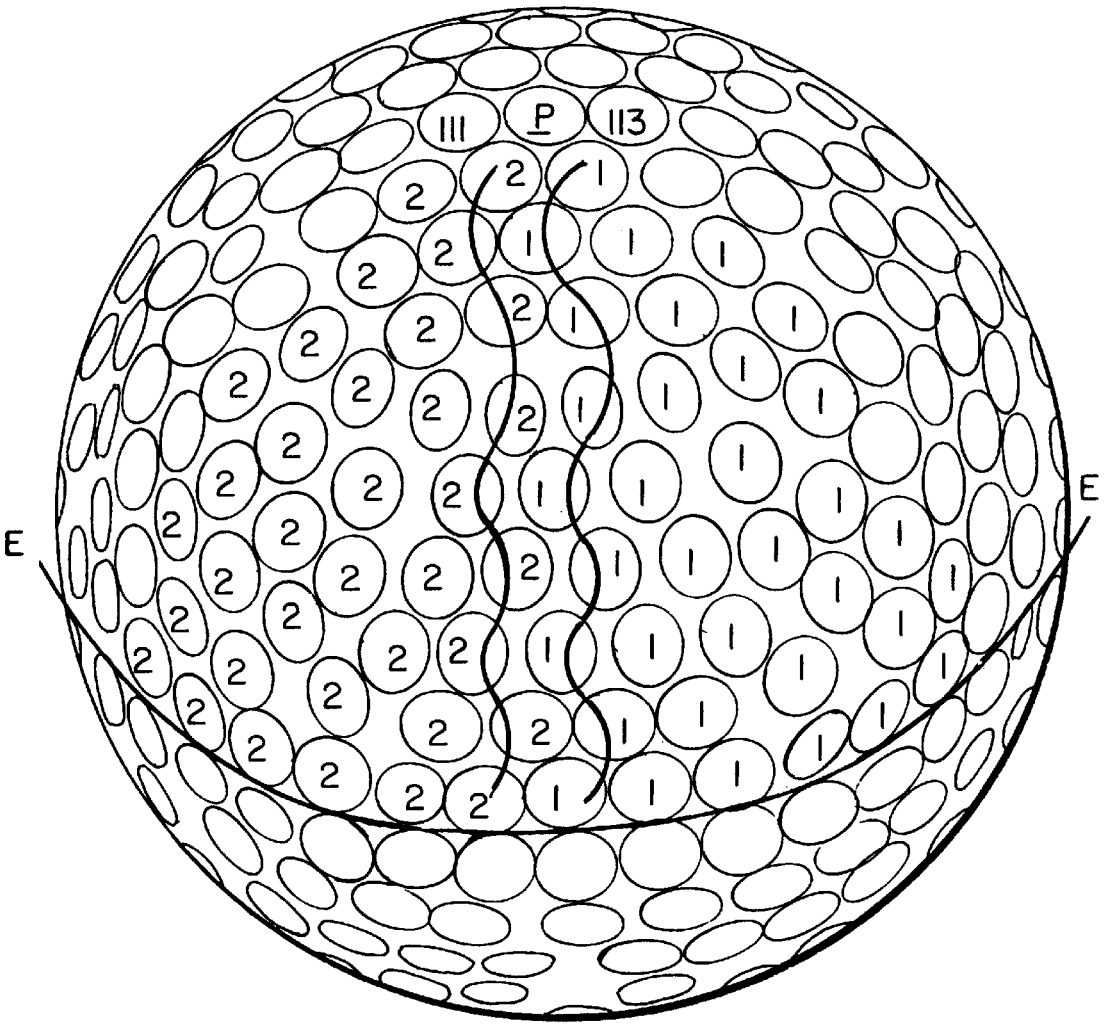

A still further modification is shown in FIG. 5. This golf ball has 422 dimples all dimples having the same diameter of 0.0143 inch and the same depth of 0.0103 inch. The dimples are arranged in a configuration so as to provide a dimple-free equatorial line, with each hemisphere of the ball having six identical dimpled substantially mating sections with a common dimple at each pole. FIG. 5 shows two mating sections having dimples 1 and 2, respectively. Each section comprises six dimples lying substantially along a line parallel with, but spaced from, the equatorial line, 29 dimples between the six dimples and the common polar dimple, with the outer dimples of each of the sections lying on modified sinusoidal lines 113 and 115.

Since only one diameter is used for all dimples, some small percentage of overlap occurs in order to provide substantial surface coverage with the dimples. For this particular pattern, there is an 11.4% (48) dimple overlap with a 73.2% coverage of the surface of the ball. Overlap is determined by finding the number of dimples having an edge overlapping any other dimple and dividing that number by the total number of dimples on the ball, such number being expressed as a percentage. Other dimple patterns can be used which provide a 65% or greater coverage on the surface of the ball.

In addition to the advantages discussed above there is easier access to the ball with the club in both the fairway and rough because of the ball's size. This easier access allows for cleaner hits. Further, the increased size and moment results in the ball's ability to hold the line during putting. Thus, by increasing the percentage of dimple coverage of the surface of the ball, the ball has the advantages attributable to the larger ball while having enhanced flight characteristics as compared to previous balls having enlarged diameters.

The above description and drawings are illustrative only since obvious modifications could be made without departing from the invention, the scope of which is to be limited only by the following claims.

What is claimed is:

1. A golf ball of improved playing characteristics, comprising (a) a spherical core;

(b) a mantle layer surrounding said core and having a Shore D hardness of 50 to 60;

(c) an outer cover layer surrounding said core and said mantle layer, said cover layer having a Shore D hardness of 65 or less, said mantle layer Shore D hardness being greater than said cover layer Shore D hardness; and (d) said cover layer containing a dimple pattern covering at least 65% of the surface of the ball, the ball having an outer diameter of substantially 1.70 to 1.80 inches and a weight no greater than 1.62 ounces.

2. A golf ball of improved playing characteristics, comprising (a) a spherical core;

(b) a mantle layer surrounding said core and having a Shore D hardness of 65 or less;

(c) an outer cover layer surrounding said core and said mantle layer, said cover layer having a Shore D hardness of 55 to 60 said cover layer Shore D hardness being greater than said mantle layer Shore D hardness; and (d) said cover layer containing a dimple pattern covering at least 65% of the surface of the ball, the ball having an outer diameter of substantially 1.70 to 1.80 inches and a weight no greater than 1.62 ounces.

* * * * *